US006397419B1

(12) United States Patent
Mechache

(10) Patent No.: US 6,397,419 B1
(45) Date of Patent: Jun. 4, 2002

(54) SYSTEM AND METHOD FOR SLEEP SURFACE ADJUSTMENT

(75) Inventor: Susan Mechache, Plymouth, MN (US)

(73) Assignee: Select Comfort Corporation, Plymouth, MN (US)

( * ) Notice: Subject to any disclaimer, the term of this patent is extended or adjusted under 35 U.S.C. 154(b) by 0 days.

(21) Appl. No.: 09/522,484

(22) Filed: Mar. 10, 2000

Related U.S. Application Data

(60) Provisional application No. 60/123,557, filed on Mar. 10, 1999.

(51) Int. Cl.[7] ..... A47C 27/10

(52) U.S. Cl. ..... 5/722; 5/713; 5/710; 5/727; 5/728; 5/738

(58) Field of Search ..... 5/710, 711, 713, 5/722, 727, 728, 738, 739, 740, 691, 709

(56) References Cited

U.S. PATENT DOCUMENTS 4,224,706 A * 9/1980 Young et al. ..... 5/710
4,449,261 A * 5/1984 Magnusson ..... 5/739
4,890,344 A * 1/1990 Walker ..... 5/713
4,951,335 A * 8/1990 Eady ..... 5/710
4,991,244 A * 2/1991 Walker ..... 5/739
5,020,176 A * 6/1991 Dotson ..... 5/713
5,642,546 A * 7/1997 Shoenhair ..... 5/739
5,960,496 A * 10/1999 Boyd ..... 5/722

* cited by examiner

*Primary Examiner*—Michael F. Trettel
(74) *Attorney, Agent, or Firm*—Oppenheimer Wolff & Donnelly LLP

(57) ABSTRACT

A system for sleep surface adjustment is described. The sleep surface is provided by a sleep support system that is configured for at least two users. The sleep surface of the sleep support system is supported by at least two fluid chambers whose pressure is independently adjustable. The fluid chambers are surrounded by an upper wall, a lower wall, and a pair of side walls; each wall has in interior and exterior surface. The system for sleep surface adjustment generally comprises a topper pad and a base pad. The topper pad is positioned above the fluid chambers and extends between the exterior surfaces of the side walls. The base pad is positioned below at least one of the fluid chambers and is used to raise that fluid chamber to a desired height if necessary.

36 Claims, 4 Drawing Sheets

SYSTEM AND METHOD FOR SLEEP SURFACE ADJUSTMENT

CLAIM TO PRIORITY

The present application claims priority to U.S. Provisional Patent Application No. 60/123,557, filed Mar. 10, 1999, was expired and entitled "System and Method for Sleep Surface Adjustment". U.S. Provisional Patent Application No. 60/123,557 is hereby incorporated by reference.

FIELD OF THE INVENTION

The present invention is related to adjustable sleep supports and, more particularly, to a system and method for maintaining a level sleep surface, thereby increasing the perceived size, comfort, and appearance of the sleep surface.

BACKGROUND OF THE INVENTION

The trend in sleep supports has started to move from standard inner spring mattresses to mattresses incorporating fluid chambers. The fluid chambers and their associated controls allow a user to adjust the pressure in the fluid chamber to a level of individual comfort. In full-, queen-and king-sized sleep supports, which are designed for two users, each side of the sleep support is provided with its own fluid chamber and controls allowing each of the two users to separately adjust their side of the support to their individual comfort level. Referring to FIG. 1, a prior art example of a dual-user, fluid chamber sleep support system 10 is shown. The two sides of the support system 10, and the locations of the fluid chambers (12, 14), are generally separated by a foam center wall 16 while the sides of the fluid chambers (12, 14) are encased by foam side walls 22 as shown. Additionally, so that the user's body is not in direct contact with the fluid chamber (12, 14), the sleep support 10, as shown in FIG. 1, is also provided with a foam topper pad 18 that extends from the interior 42 of first foam side wall 22 to interior 42 of second foam side wall 22; all components are preferably encased in a cover 32.

The above-described configuration, while providing satisfactory comfort for a number of users, has also found some users dissatisfied. As a first example, refer again to the prior art configuration of FIG. 1, wherein one user prefers a firm fluid chamber 12 setting while the other user prefers a soft fluid chamber 14 setting. In this first example, the firm side user may feel as though, to one side, they are rolling off the edge of the sleep support and, to the other side, as though they are rolling to the middle due to the other user's softer setting. The soft side user in this same example may feel as though they are stuck in a valley and find it difficult to roll to either side of the sleep support.

A second example is shown in the prior art configuration of FIG. 2, wherein both users prefer a firm fluid chamber (12, 14) setting. In this second example, both users may have the feeling that they are rolling to and off the edge of the sleep support. A third example is shown in the prior art example of FIG. 3, wherein both users prefer a soft fluid chamber (12, 14) setting. In this third example, both users may feel as though they are stuck in a valley, unable to roll to either the center or edge of the sleep support. Further, the users in the third example may find that they are actually able to feel the center wall.

In view of the prior art configurations and the potential dissatisfactions that may result, there is a need to provide users with a sleep support that can provide a substantially level, or even, sleep surface while still allowing the user to adjust the pressure within the fluid chamber to the user's most comfortable sleep setting.

SUMMARY OF THE INVENTION

The needs described above are in large measure met by a system for sleep surface adjustment of the present invention. The sleep surface is provided by a sleep support system that is configured for at least two users. The sleep surface of the sleep support system is supported by at least two fluid chambers whose pressure is independently adjustable. The fluid chambers are surrounded by an upper wall, a lower wall, and a pair of side walls; each wall has in interior and exterior surface. The system for sleep surface adjustment generally comprises a topper pad and a base pad. The topper pad is positioned above the fluid chambers and extends between the exterior surfaces of the side walls. The base pad is positioned below at least one of the fluid chambers and is used to raise that fluid chamber to a desired height if necessary.

The base pad may be in the configuration of a layer of foam or an additional fluid chamber. In the instance of the latter configuration, the additional fluid chamber may have an independently adjustable fluid pressure setting or, alternatively, may be unitary with one of the earlier-described fluid chambers. The unitary embodiment may provide for the exchange of fluid between the fluid chamber and the additional fluid chamber to maintain the desired height. The desired height is generally defined to be the top height of the side walls so that the fluid chambers are substantially level with the side walls.

A method for adjusting the sleep surface of the sleep support system described above generally includes the following steps: (1) determining a desired height for each of the fluid chambers within the sleep support system; (2) positioning a base pad beneath at least one of the fluid chambers; (3) lifting the fluid chamber with the base pad, if necessary to achieve the desired height; and (4) placing a topper pad atop the fluid chambers and ensuring that the topper pad extends from the exterior surface of one side wall to the exterior surface of the other side wall.

The topper pad is used to provide a smooth transition from a fluid chamber area to a walled support area. The base pad(s) are used to even out any major or minor height differences in the fluid chambers that may occur due to differences in the pressurization of the fluid chambers. The use of topper pad and base pad(s) provides a level sleep surface for the user and, as such, increases the perceived size of the sleep surface.

DETAILED DESCRIPTION OF THE PREFERRED EMBODIMENTS

Figure 1:
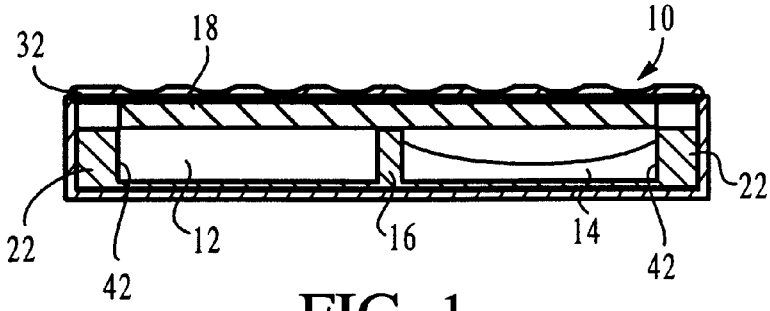
FIG. 1 PRIOR ART
FIG. 1 depicts a prior art configuration of a sleep support incorporating two fluid chambers for two individual users, wherein one user prefers a firm fluid chamber setting and the other user prefers a soft fluid chamber setting.

A sleep support system 10 for sleep surface adjustment of the present invention provides the users with a substantially even sleep surface while still allowing each user to adjust the sleep support system 10 to their individual comfort level.

Referring to FIGS. 4–8, sleep support system 10 generally incorporates a first fluid chamber 12 and a second fluid chamber 14. First fluid chamber 12 is separated from second fluid chamber 14 by a foam center wall 16. First fluid chamber 12 and second fluid chamber 14 are surrounded by an upper wall 26, lower wall 30 and side walls 22. Each fluid chamber 12 and 14 is provided with controls for independent pressure adjustability. Details as to the construction and operation of fluid chambers 12 and 14, as well as the structure surrounding the fluid chambers 12 and 14, may be found in U.S. Pat. Nos. 5,509,154; 5,564,140; 4,991,244; 5,144,706; 4,908,895; 4,829,616; 4,890,344; 5,642,546; 5,652,484; 5,170,522; 5,903,941; 5,904,172; and 5,765,246, each of which is hereby incorporated by reference.

In the present invention, an edge-to-edge topper pad 19 is provided in the configuration of a thickness of foam that extends from an exterior edge 20 of side wall 22 to exterior edge 20 of second side wall 22, and from exterior edge 24 of upper wall 26 to exterior edge 28 of lower wall 30, thereby covering fluid chambers 12 and 14. Topper pad 19 is preferably of a soft cushioning foam that conforms to the user's body, e.g., a Q16 foam. Topper pad 19 may be of any suitable thickness, e.g., 1.75 inches to 2.00 inches, and is maintained in position by a cover 32, having a top portion 34 and lower portion 36, that encases the components of sleep support system 10. Top portion 34 and lower portion 36 are preferably secured to one another by a suitable attachment means as a zipper, a hook and loop fastener, etc. Top portion 34 of cover 32 presents the sleep surface 37 to the user.

Base pad 38 may comprise a thickness of foam that extends from interior 40 of center wall 16 to interior 42 of side wall 22. One or more of base pads 38 may be placed below one or both of fluid chambers 12 and 14. Base pad 38 is used to lift fluid chamber 12 and/or 14 to a level that is substantially even with the top 44 of side walls 22. Because base pad 38 is performing a lifting function, the foam comprising base pad 38 is preferably of a stiffer nature, e.g., L9 foam, than the foam of topper pad 19. Base pad 38 is of an appropriate thickness, e.g., 1 inch, to lift fluid chamber 12 and/or 14 to a position that is substantially level with the top 44 of side walls 22 when fluid chamber 12 and/or 14 is at a user's adjusted and desired pressure level.

Alternatively, base pad 38 may comprise an additional fluid chamber 46 that may be adjustably pressurized independent of fluid chambers 12 and/or 14. As with base pad 38 in a foam configuration, base pad 38 in the configuration of an additional fluid chamber 46 is preferably placed below fluid chamber 12 and/or 14 and performs a lifting function. Once again, the goal of the lifting function is to raise fluid chamber 12 and/or 14 to a position that is substantially level with the top 44 of side walls 22 when fluid chamber 12 and/or 14 is at a user's adjusted and desired pressure level.

Figure 5:
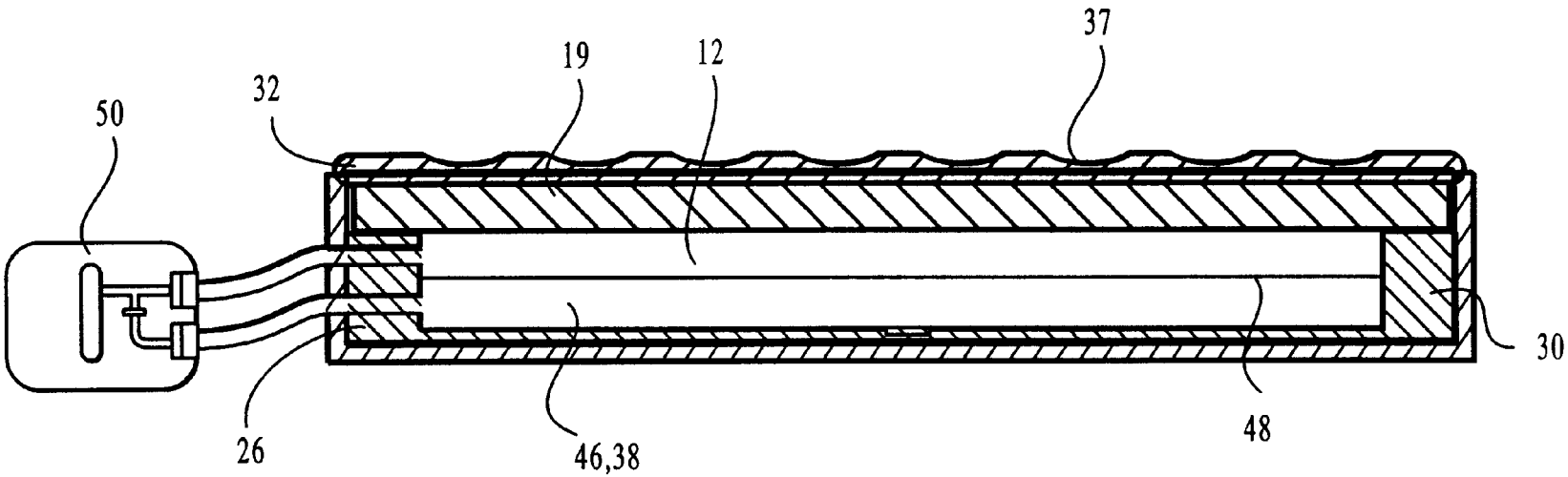
FIG. 5 depicts a side view of a unitary fluid chamber/base pad configuration of the present invention.

Still another alternative for base pad 38 is the unitary combination of fluid chamber 12 or 14 with additional fluid chamber 46, as shown in FIG. 5. In this instance, fluid chamber 12 is separated internally from fluid chamber 46 by an internal baffling system 48. Further, as the pressure in fluid chamber 12 decreases, the pressure in fluid chamber 46 of base pad 38 increases automatically to maintain fluid chamber 12 at its starting height. In a preferred mode of operation, fluid chamber 12 is initially inflated through use of a fluid pump 50 and hand control (not shown) to its maximum firmness wherein fluid chamber 46 is essentially void of any pressurization. Then, the user utilizes the hand control to change the flow of air, i.e., a switch is flipped on the hand control whereby fluid pump 50 no longer supplies pressurizing fluid to fluid chamber 12 rather, fluid is now allowed flow between fluid chamber 12 and fluid chamber 46.

As such, utilizing hand control to now decrease the firmness of fluid chamber 12 causes the pressurizing fluid to flow from fluid chamber 12 to fluid chamber 46 thereby maintaining the height of fluid chamber 12 even though it is at a reduced pressure setting. Likewise, utilizing the hand control to later increase the firmness in fluid chamber 12 causes the pressurizing fluid to flow from fluid chamber 46 of base pad 38 to fluid chamber 12, thereby maintaining the height of fluid chamber 12. Alternatively, fluid chamber 12 and additional fluid chamber 46 may be maintained in an independently adjustable configuration without any exchange of fluid.

As described in the "Background of the Invention", the users of a dual-person sleep support system utilizing pressure-adjustable fluid chambers face three possible fluid chamber configurations. In the first configuration, as shown in the prior art example of FIG. 1, fluid chamber 12 is established at a firm pressure setting while fluid chamber 14 is established at a soft pressure setting. In this situation, the user preferring the firm pressure setting has the tendency to feel as though they are rolling to the edge or the middle of sleep support system 10 while the user preferring the soft pressure setting has the tendency to feel as though they are stuck in a valley and unable to roll to either side of sleep support system 10.

Figure 6:
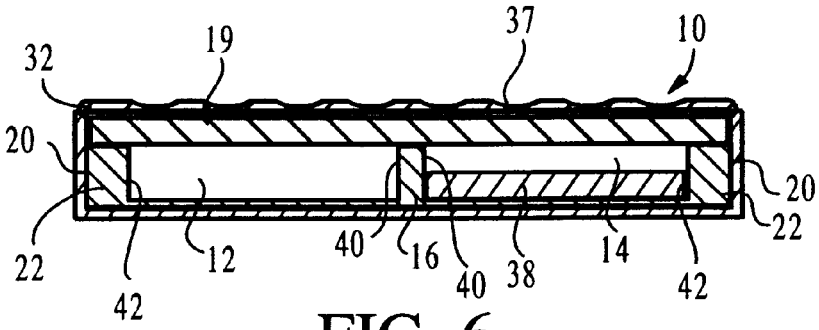
FIG. 6 depicts the configuration of FIG. 1 utilizing the sleep support system of the present invention.

Sleep support system 10 for sleep surface adjustment of the present invention addresses these problems with the configuration of FIG. 6. In this configuration, base pad 38 is placed beneath fluid chamber 14, the fluid chamber with the soft pressure setting, thereby raising it to a position that is level with top 44 of side walls 22. Further, topper pad 18 of FIG. 1 is replaced with edge-to-edge topper pad 19. As such, the drop that exists from topper pad 18 to side wall 22 in FIG. 1 is eliminated, as shown in FIG. 6, and the user preferring the firm pressure setting in fluid chamber 12 no longer experiences the sensation of rolling off the edge of sleep surface 37 of sleep support system 10. Moreover, because fluid chamber 14 (softer pressure setting) has been raised to a position that is substantially level with fluid chamber 12 and tops 44 of side walls 22 without altering the soft pressure setting of fluid chamber 14, the user is provided with a soft feel absent any sinking, or valley-type feeling.

Figure 2:
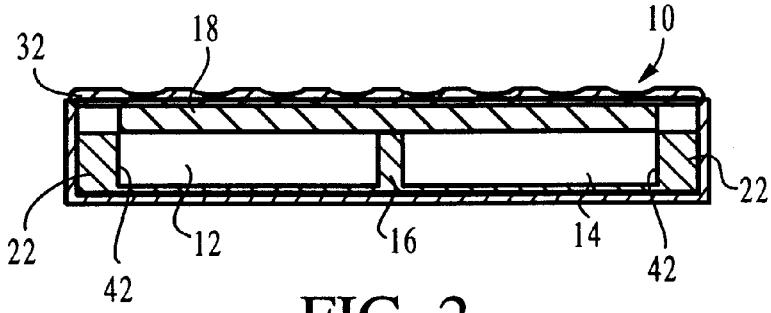
FIG. 2 PRIOR ART
FIG. 2 depicts a prior art configuration of a sleep support incorporating two fluid chambers for two individual users, wherein both users prefer a firm fluid chamber setting.
Figure 7:
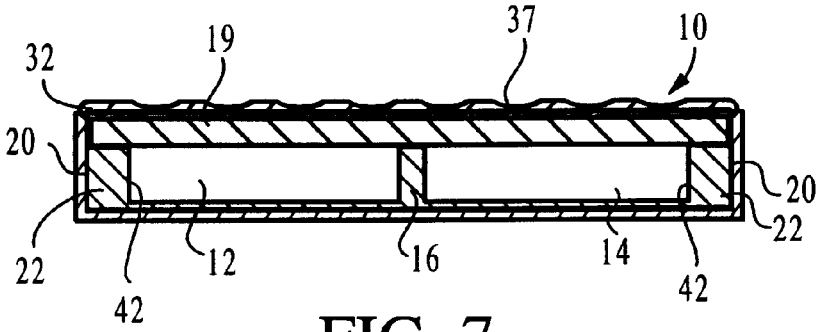
FIG. 7 depicts the configuration of FIG. 2 utilizing the sleep support system of the present invention.
Figure 8:
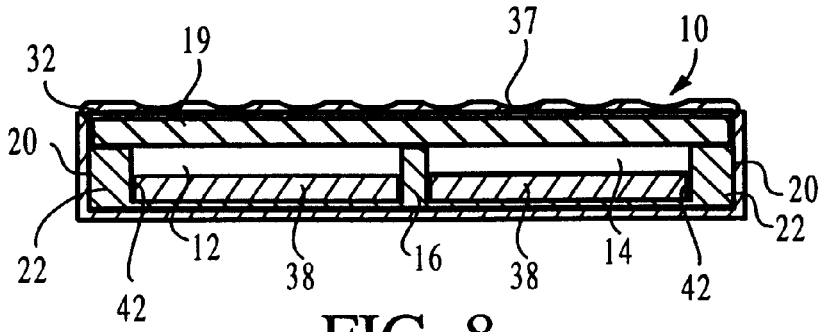
FIG. 8 depicts the configuration of FIG. 3 utilizing the sleep support system of the present invention.

In the second configuration, as shown in the prior art example of FIG. 2, fluid chamber 12 is established at a firm pressure setting as is fluid chamber 14. In this situation, both users have the tendency to feel as though they are rolling off the edge of sleep support system 10. Sleep support system 10 for sleep surface adjustment of the present invention addresses this problem with the configuration of FIG. 7. In this configuration, topper pad 18 is replaced with edge-to-edge topper pad 19. As such, the drop that exists from topper pad 18 to side wall 22 in FIG. 2 is eliminated, as shown in FIG. 7, and the users no longer experience the sensation of rolling off the edge of sleep surface 37 of sleep support system 10. Base pad 38 may or may not be required depending on the difference in pressure settings of fluid chamber 12 and fluid chamber 14.

Figure 3:
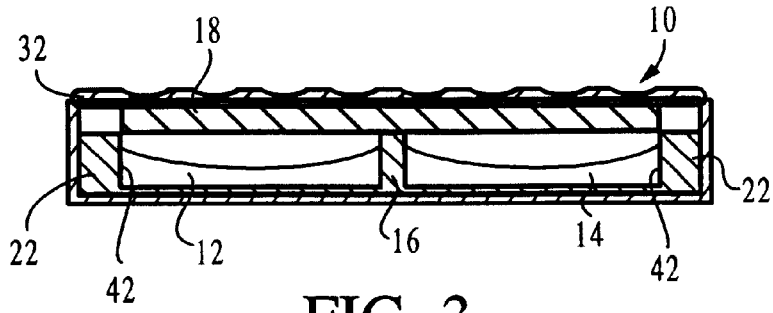
FIG. 3 PRIOR ART
FIG. 3 depicts a prior art configuration of a sleep support incorporating two fluid chambers for two individual users, wherein both users prefer a soft fluid chamber setting.
Figure 4:
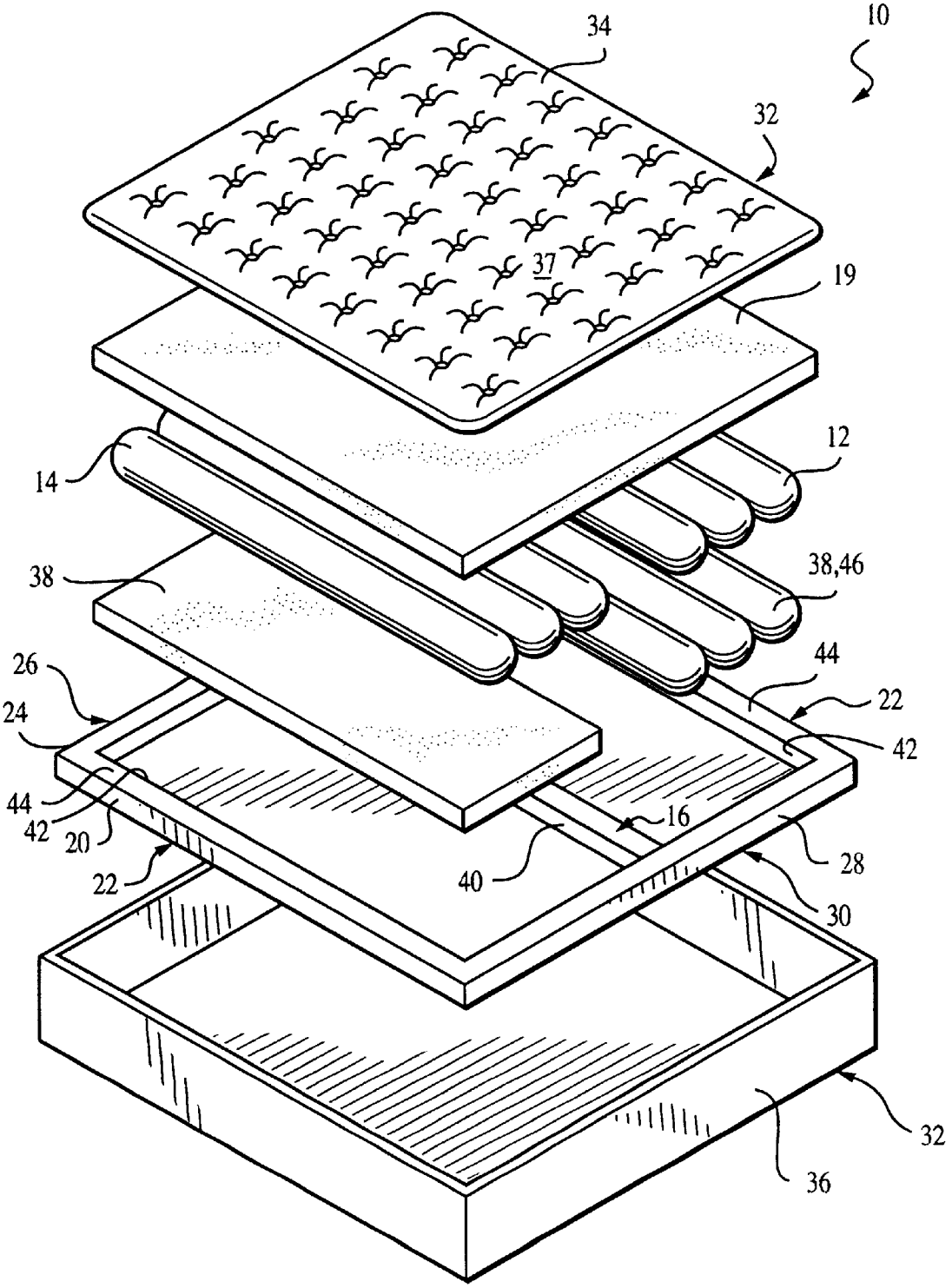
FIG. 4 depicts a perspective view of the sleep support system of the present invention.

In the third configuration, as shown in the prior art example of FIG. 3, fluid chamber 12 is established at a soft pressure setting as is fluid chamber 14. In this situation, both users have the tendency to feel as though they are stuck within a valley, unable to roll to either side of sleep support system 10. Sleep support system 10 for sleep surface adjustment of the present invention addresses this problem with the configuration of FIG. 8. In this configuration, one or more base pads 38 is placed below each of fluid chambers 12 and 14. Base pads 38 operate to lift their respective fluid chamber 12, 14 to a height such that the top of fluid chambers 12 and 14 is substantially level with tops 44 of side walls 22. Further, topper pad 18 of FIG. 3 is replaced with edge-to-edge topper pad 19. As such, a substantially leveled sleep surface 37 is provided for the users, the sinking valley feeling is eliminated, and sleep surface 37 visually presents itself as full and level instead of "w"-like.

The determination of whether to use base pad 38 with fluid chamber 12 and/or 14 is generally left to the individual users. However, the following are provided as user guidelines. First, if both fluid chambers 12, 14 are at a sleep setting (see the earlier cited patents for a description of sleep setting) of 50 or less, on a scale of 0–100 which may correspond to a linear or non-linear progression of fluid pressures, implying soft fluid chambers 12, 14, base pad 38 should be used under both fluid chamber 12 and fluid chamber 14. Second, if both fluid chambers 12, 14 are at a sleep setting of 55 or more, base pad 38 should not be used. Third, if the sleep settings of fluid chambers 12 and 14 differ by more than 10, base pad 38 should be used under the softer of the two fluid chambers. Edge-to-edge topper pad 19 is preferably used in all situations. The use of topper pad 19 and/or base pad 38 produces a level sleeping surface for the dual users and, as such, also provides a smooth transition from the fluid chambers 12 and 14 to upper wall 26, lower wall 30 and side walls 22. The use of topper pad 19 also tends to increase the perceived size, comfort, and appearance of the sleep surface of sleep support system 10.

In the instance wherein base pad 38 is of the additional fluid chamber 46 configuration, base pad 38 may be left in position below fluid chambers 12 and 14 and inflated or deflated as necessary to maintain fluid chamber 12 and/or 14 at a desired height.

The present invention may be embodied in other specific forms without departing from the spirit of the essential attributes thereof, therefore, the illustrated embodiments should be considered in all respects as illustrative and not restrictive, reference being made to the appended claims rather than to the foregoing description to indicate the scope of the invention.

What is claimed:

1. A system for sleep surface adjustment, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall and a pair of side walls each having an interior and exterior, said system comprising:

a topper pad, said topper pad positioned above said fluid chambers and extending from said exterior of one of said pair of side walls to said exterior of the other of said pair of side walls; and a cover encasing said topper pad, said upper wall, said lower wall and said pair of side walls.

2. The system of claim 1, wherein said topper pad extends from said exterior of said upper wall to said exterior of said lower wall.

3. The system of claim 1, further comprising a base pad, wherein said base pad is positioned below at least one of said fluid chambers and is used to raise said fluid chamber to a desired height if necessary to reach said desired height.

4. The system of claim 3, wherein said desired height is defined as a top height of said pair of said side walls.

5. The system of claim 3, wherein said base pad comprises a layer of foam.

6. The system of claim 3, wherein said base pad comprises an additional fluid chamber.

7. The system of claim 6, wherein said additional fluid chamber has an independently adjustable fluid pressure setting.

8. The system of claim 6, wherein said additional fluid chamber is unitary with said fluid chamber.

9. The system of claim 8, wherein said fluid chamber and said additional fluid chamber exchange fluid to maintain said fluid chamber at a desired height.

10. A system for sleep surface adjustment, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall, and a pair of side walls each having an interior and an exterior, said system comprising:

a topper pad, said topper pad positioned above said fluid chambers and extending from said exterior of one of said pair of side walls to said exterior of the other of said pair of side walls; and a base pad, wherein said base pad is positioned below at least one of said fluid chambers and is used to lift said fluid chamber to a desired height if necessary to reach said desired height.

11. The system of claim 10, wherein said topper pad extends from said exterior of said upper wall to said exterior of said lower wall.

12. The system of claim 10, wherein said desired height is defined as a top height of said pair of side walls.

13. The system of claim 10, wherein said base pad comprises a layer of foam.

14. The system of claim 10, wherein said base pad comprises an additional fluid chamber.

15. The system of claim 14, wherein said additional fluid chamber has an independently adjustable fluid pressure setting.

16. The system of claim 14, wherein said additional fluid chamber is unitary with said fluid chamber.

17. The system of claim 16, wherein said fluid chamber and said additional fluid chamber exchange fluid to maintain said fluid chamber at a desired height.

18. A method for adjusting a sleep surface, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall, and a pair of side walls each having an interior and exterior, said method comprising the steps of:

determining a desired height for said fluid chambers within said sleep support system;

positioning a base pad beneath at least one of said fluid chambers;

lifting said fluid chamber with said base pad if necessary to achieve said desired height; and placing a topper pad atop said fluid chambers, wherein said topper pad extends from said exterior of one of said pair of side walls to said exterior of the other of said pair of side walls.

19. The method of claim 18, wherein said desired height is defined as a top height of said pair of side walls.

20. The method of claim 18, wherein said topper pad extends from said exterior of said upper wall to said exterior of said lower wall.

21. The method of claim 18, wherein said base pad comprises a layer of foam.

22. The method of claim 18, wherein said base pad comprises an additional fluid chamber.

23. The method of claim 22, wherein said additional fluid chamber has an independently adjustable fluid pressure setting.

24. The method of claim 22, wherein said additional fluid chamber is unitary with said fluid chamber.

25. The method of claim 24, wherein said fluid chamber and said additional fluid chamber exchange fluid to maintain said fluid chamber at said desired height.

26. A system for sleep surface adjustment, wherein said sleep surface is provided by a sleep support system that is configured for a least two users, wherein said sleep surface is supported by a least two fluid chambers whose pressure is independently adjustable, and wherein said two fluid chambers are surrounded by an upper wall, a lower wall and a pair of side walls each having an interior and exterior, said system comprising:

a topper pad, said topper pad positioned above said fluid chambers and extending from said exterior of one of said pair of side walls to said exterior of the other of said pair of side walls;

a cover encasing said topper pad, said upper wall, said lower wall and said pair of side walls; and a base pad positioned below at least one of said fluid chambers and used to raise said fluid chamber to a desired height if necessary to reach said desired height, said base pad comprising an additional fluid chamber.

27. The system of claim 26, wherein said additional fluid chamber has an independently adjustable fluid pressure setting.

28. The system of claim 26, wherein said additional fluid chamber is unitary with said fluid chamber.

29. The system of claim 28, wherein said fluid chamber and said additional fluid chamber exchange fluid to maintain said fluid chamber at a desired height.

30. A system for sleep surface adjustment, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall, and a pair of side walls each having an interior and an exterior, said system comprising:

a topper pad, said topper pad positioned above said fluid chambers and extending from said exterior of one of said pair of side walls to said exterior of the other of said pair of side walls; and a base pad comprising an additional fluid chamber, wherein said base pad is positioned below at least one of said fluid chambers and is used to lift said fluid chamber to a desired height if necessary to reach said desired height.

31. The system of claim 30, wherein said additional fluid chamber has an independently adjustable fluid pressure setting.

32. The system of claim 30, wherein said additional fluid chamber is unitary with said fluid chamber.

33. The system of claim 32, wherein said fluid chamber and said additional fluid chamber exchange fluid to maintain said fluid chamber at a desired height.

34. A method for adjusting a sleep surface, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall, and a pair of side walls each having an interior and exterior, said method comprising the steps of:

determining a desired height for said fluid chambers within said sleep support system;

positioning a base pad comprising an additional fluid member beneath at least one of said fluid chambers;

lifting said fluid chamber with said base pad if necessary to achieve said desired height; and placing a topper pad atop said fluid chambers, wherein said topper pad extends from said exterior of one of said pair of side walls to said exterior of the other of said pair of side walls.

35. The method of claim 34, wherein said additional fluid chamber has an independently adjustable fluid pressure setting.

36. The method of claim 34, wherein said fluid chamber and said additional fluid chamber exchange fluid to maintain said fluid chamber at said desired height.

* * * * *

US006397419C1

(12) EX PARTE REEXAMINATION CERTIFICATE (10244th)

United States Patent
Mechache

(10) Number: US 6,397,419 C1
(45) Certificate Issued: Aug. 6, 2014

(54) SYSTEM AND METHOD FOR SLEEP SURFACE ADJUSTMENT

(75) Inventor: Susan Mechache, Plymouth, MN (US)

(73) Assignee: Select Comfort Corporation, Plymouth, MN (US)

Reexamination Request:
No. 90/012,445, Aug. 22, 2012

Reexamination Certificate for:

| | |
|---|---|
| Patent No.: | **6,397,419** |
| Issued: | **Jun. 4, 2002** |
| Appl. No.: | **09/522,484** |
| Filed: | **Mar. 10, 2000** |

Related U.S. Application Data

(60) Provisional application No. 60/123,557, filed on Mar. 10, 1999.

(51) Int. Cl.
*A47C 17/00* (2006.01)

(52) U.S. Cl.
USPC ..... 5/722; 5/713; 5/710; 5/727; 5/728; 5/738

(58) Field of Classification Search
None
See application file for complete search history.

(56) References Cited

To view the complete listing of prior art documents cited during the proceeding for Reexamination Control Number 90/012,445, please refer to the USPTO's public Patent Application Information Retrieval (PAIR) system under the Display References tab.

*Primary Examiner* — Aaron J. Lewis

(57) ABSTRACT

A system for sleep surface adjustment is described. The sleep surface is provided by a sleep support system that is configured for at least two users. The sleep surface of the sleep support system is supported by at least two fluid chambers whose pressure is independently adjustable. The fluid chambers are surrounded by an upper wall, a lower wall, and a pair of side walls; each wall has in interior and exterior surface. The system for sleep surface adjustment generally comprises a topper pad and a base pad. The topper pad is positioned above the fluid chambers and extends between the exterior surfaces of the side walls. The base pad is positioned below at least one of the fluid chambers and is used to raise that fluid chamber to a desired height if necessary.

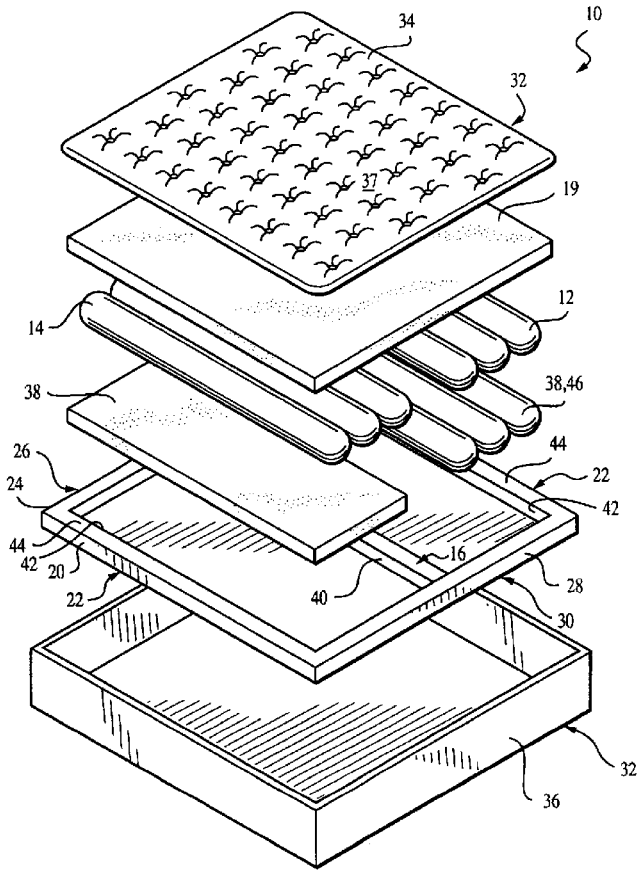

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 18-25 and 34-36 is confirmed.

Claims 3, 5 and 13 are cancelled.

Claims 1, 4, 6, 10, 26 and 30 are determined to be patentable as amended.

Claims 2, 7-9, 11, 12, 14-17, 27-29 and 31-33, dependent on an amended claim, are determined to be patentable.

New claims 37-49 are added and determined to be patentable.

1. A system for sleep surface adjustment, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall and a pair of side walls each having an interior and exterior, said system comprising:

a topper pad, said topper pad positioned above said fluid chambers and extending from said exterior of one of said pair of side walls to said exterior of the other of said pair of side walls; [and]

a cover encasing said topper pad, said upper wall, said lower wall and said pair of side walls*; and*

*a base pad, wherein said base pad is positioned below at least one of said fluid chambers and is used to raise said fluid chamber to a desired height if necessary to reach said desired height, wherein said base pad comprises a layer of foam;*

*wherein said two fluid chambers include a first fluid chamber supported by a first base portion disposed between said upper wall and said lower wall and a second fluid chamber supported by a second base portion disposed between said upper wall and said lower wall; and*

*wherein said base pad is positioned above said first base portion and below said first fluid chamber and not below said second fluid chamber*.

4. The system of claim [3] *1*, wherein said desired height is defined as a top height of said pair of said side walls.

6. The system of claim [3] *1*, wherein said base pad comprises an additional fluid chamber.

10. A system for sleep surface adjustment, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall, and a pair of side walls each having an interior and an exterior, said system comprising:

a topper pad, said topper pad positioned above said fluid chambers and extending from said exterior of one of said pair of side walls to said exterior of the other of said pair of side walls;

*a cover encasing said topper pad, said upper wall, said lower wall and said pair of side walls;* and a *removable* base pad, wherein said base pad is positioned below at least one of said fluid chambers and is used to lift said fluid chamber to a desired height if necessary to reach said desired height*, wherein said base pad comprises a layer of foam;*

*wherein said two fluid chambers include a first fluid chamber and a second fluid chamber; and*

*wherein said base pad is positioned above a lower surface of said cover and below said first fluid chamber and not below said second fluid chamber*.

26. A system for sleep surface adjustment, wherein said sleep surface is provided by a sleep support system that is configured for a least two users, wherein said sleep surface is supported by a least two fluid chambers whose pressure is independently adjustable, and wherein said two fluid chambers are surrounded by an upper wall, a lower wall and a pair of side walls each having an interior and exterior, said system comprising:

a topper pad, said topper pad positioned above said fluid chambers and extending from said exterior of one of said pair of side walls to said exterior of the other of said pair of side walls;

a cover encasing said topper pad, said upper wall, said lower wall and said pair of side walls; and a base pad positioned below at least one of said fluid chambers and used to raise said fluid chamber to a desired height if necessary to reach said desired height, said base pad comprising an additional fluid chamber*;*

*wherein said two fluid chambers include a first fluid chamber supported by a first base portion disposed between said upper wall and said lower wall and a second fluid chamber supported by a second base portion disposed between said upper wall and said lower wall; and*

*wherein said base pad is positioned above said first base portion and below said first fluid chamber and not below said second fluid chamber*.

30. A system for sleep surface adjustment, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall, and a pair of side walls each having an interior and an exterior, said system comprising:

a topper pad, said topper pad positioned above said fluid chambers and extending from said exterior of one of said pair of side walls to said exterior of the other of said pair of side walls; and a base pad comprising an additional fluid chamber, wherein said base pad is positioned below at least one of said fluid chambers and is used to lift said fluid chamber to a desired height if necessary to reach said desired height*;*

*wherein said two fluid chambers include a first fluid chamber supported by a first base portion disposed between said upper wall and said lower wall and a second fluid chamber supported by a second base portion disposed between said upper wall and said lower wall; and*

*wherein said base pad is positioned above said first base portion and below said first fluid chamber and not below said second fluid chamber*.

*37. The system of claim 1 wherein no base pad is positioned between said second fluid chamber and said second base portion.*

*38. The system of claim 1, wherein a second base pad is positioned between said second fluid chamber and said second base portion.*

*39. The system of claim 38, wherein said base pad under said first fluid chamber has a first height and said second base pad under said second fluid chamber has a second height different than said first height.*

*40. The system of claim 38, wherein said base pad and said second base pad are separate.*

*41. The system of claim 1, wherein said first fluid chamber and said second fluid chamber are adjusted to different pressure levels and have different thicknesses, and wherein said base pad lifts said first fluid chamber to said desired height, and wherein said second fluid chamber is disposed above said second base portion with a top at about said desired height using no base pad or a second base pad different from said base pad below said first fluid chamber.*

*42. The method of claim 18, wherein determining a desired height for said fluid chambers includes providing one or more user-insertable base pads for lifting a fluid chamber.*

*43. The method of claim 34, wherein determining a desired height for said fluid chambers includes providing one or more user-insertable base pads for lifting a fluid chamber.*

*44. A system for sleep surface adjustment, wherein said sleep surface is provided by a sleep support system that is configured for at least two users, wherein said sleep surface is supported by at least two fluid chambers whose pressure is independently adjustable, and wherein said two fluid chambers are surrounded by an upper wall, lower wall, and a pair of side walls each having an interior and an exterior, said system comprising:*

*a topper pad, said topper pad positioned above said fluid chambers and extending from said exterior of one of said pair of side walls to said exterior of the other of said pair of side walls;*

*a base pad, wherein said base pad is positioned below at least one of said fluid chambers and is used to raise said fluid chamber to a desired height if necessary to reach said desired height, wherein said base pad comprises a layer of foam;*

*wherein said two fluid chambers include a first fluid chamber supported by a first base portion disposed between said upper wall and said lower wall and a second fluid chamber supported by a second base portion disposed between said upper wall and said lower wall; and*

*a cover encasing said topper pad, said upper wall, said lower wall, said pair of side walls, and said first and second base portions.*

*45. The system of claim 1, wherein said first base portion and said second base portion are unitary.*

*46. The system of claim 26, wherein said first base portion and said second base portion are unitary.*

*47. The system of claim 30, wherein said first base portion and said second base portion are unitary.*

*48. The system of claim 44, wherein said first base portion and said second base portion are unitary.*

*49. The system of claim 44, wherein said first fluid chamber and said second fluid chamber are adjusted to different pressure levels and have different thicknesses, and wherein said base pad is disposed on the first base portion and lifts said first fluid chamber to said desired height, and wherein said second fluid chamber is disposed above said second base portion with a top at about said desired height using no base pad or a second base pad different from said base pad below said first fluid chamber.*

* * * * *